United States Patent [19]

Uesugi et al.

[11] Patent Number: 4,854,273

[45] Date of Patent: Aug. 8, 1989

[54] OIL PRESSURE CONTROL APPARATUS FOR AN INTERNAL COMBUSTION ENGINE

[75] Inventors: Tatsuya Uesugi; Eiji Nakai, both of Hiroshima, Japan

[73] Assignee: Mazda Motor Corporation, Hiroshima, Japan

[21] Appl. No.: 142,934

[22] Filed: Jan. 12, 1988

[30] Foreign Application Priority Data

Jan. 13, 1987 [JP] Japan ..... 62-5270

[51] Int. Cl.[4] ..... F01L 1/08; F01L 1/34; F01L 1/24

[52] U.S. Cl. ..... 123/90.17; 123/90.16; 123/90.46; 123/90.36

[58] Field of Search ..... 123/90.12, 90.13, 90.16, 123/90.17, 90.18, 90.6, 90.39, 90.33, 90.36, 90.43, 90.46, 90.55

[56] References Cited

U.S. PATENT DOCUMENTS

| | | | |
|---|---|---|---|
| 4,388,897 | 6/1983 | Rosa | 123/90.17 |
| 4,537,165 | 8/1985 | Honda et al. | 123/90.16 |
| 4,589,387 | 5/1986 | Miura et al. | 123/90.16 X |
| 4,612,884 | 9/1986 | Ajiki et al. | 123/90.16 |
| 4,656,977 | 4/1987 | Nagahiro et al. | 123/90.16 |
| 4,671,221 | 6/1987 | Geringer et al. | 123/90.16 |
| 4,690,110 | 9/1987 | Nishimura et al. | 123/90.17 |
| 4,730,588 | 3/1988 | Maeda | 123/90.18 X |

FOREIGN PATENT DOCUMENTS

| | | | |
|---|---|---|---|
| 2950656 | 6/1981 | Fed. Rep. of Germany | 123/90.17 |
| 59-231118 | 12/1984 | Japan . | |
| 61-058605 | 4/1986 | Japan . | |
| 0212615 | 9/1986 | Japan | 123/90.17 |

*Primary Examiner*—Willis R. Wolfe

*Attorney, Agent, or Firm*—Fleit, Jacobson, Cohn, Price Holman & Stern

[57] ABSTRACT

An oil pressure control apparatus for a valve driving system for an internal combustion engine, in which a main oil supply passage feeds oil to a hydraulic actuator of the engine valve driving apparatus. A control valve is provided for closing the oil supply passage. A bypass oil passage bypasses the control valve continuously. The control valve, when closed, regulates the oil pressure to below a predetermined value and the oil pressure is insufficient to actuate the hydraulic actuator. When the control valve is opened, responsive to an engine operating condition such as engine speed, oil pressure is above the predetermined value, and the hydraulic actuator is actuated rapidly to shift the valve driving system from low speed to high speed operation.

16 Claims, 7 Drawing Sheets

OIL PRESSURE CONTROL APPARATUS FOR AN INTERNAL COMBUSTION ENGINE

FIELD OF THE INVENTION

The present invention relates to an oil pressure control apparatus for an internal combustion engine, and more particularly to an oil pressure control apparatus for an engine valve driving system capable of selecting one of a plurality of cams for driving an intake valve and/or an exhaust valve in accordance with engine operating conditions.

BACKGROUND OF THE INVENTION

Engine valve driving systems are known which have a plurality of cams for driving an intake and/or exhaust valve to change valve timing and/or the quality of the valve lift in accordance with an engine operating condition. One such engine valve driving system is described in unexamined Japanese Utility Model Publication No. 58605/1986. This system provides a first rocker arm pivotally mounted on a rocker shaft for driving an intake valve under low speed engine operating conditions, in accordance with the movements of a low speed cam having a cam lobe suitable for low speed engine operation. Beside the first rocker arm is a second rocker arm pivotally mounted on a rocker shaft for driving the intake valve under high speed engine operating conditions, in accordance with the movements of a high speed cam having a cam lobe suitable for high speed cam operation. Engaging means engages the second rocker arm with the first rocker arm under high engine RPM and disengages the second rocker arm from the first rocker arm under low engine RPM.

An operating oil supply system for another type of engine valve driving apparatus is described in unexamined Japanese Patent Publication No. 59-231118 (U.S. Pat. No. 4,537,165). This reference discloses an operating oil supply system for a valve actuating mechanism having a stopping function, with a plunger selectively positioned by operating oil pressure controlled by an oil pressure control valve, which is actuated in response to engine operating conditions.

However, utilizing the above-mentioned systems requires rapid shifting of the plunger between an inoperative and operative position, and it is usually necessary to shift into the operative position several times before the oil supply passage is filled and the plunger beings to work, which can be relatively time-consuming.

In order to overcome this problem, an accumulator or similar mechanism is used with the oil pressure control apparatus. However, in an internal combustion engine, it is still difficult to raise the oil pressure to a sufficient level, especially when the engine is running at low speed. Nor does lowering the operating pressure of the plunger serve as an appropriate correction, since such action would require weakening the force of a return spring for the plunger, thereby requiring even more time to shift the plunger from the operative to inoperative position. Further, where the oil passage serves both as an operating oil and lubricating oil supply passage, it is difficult to lower the set pressure of the plunger below that of a predetermined limit value for preventing insufficient oil supply.

SUMMARY OF THE INVENTION

Therefore, the present invention is designed to solve the above-described problem by way of a novel oil pressure control apparatus which is able to respond quickly when shifting the plunger in systems where the oil passage serves as both a lubricating oil supply and operating oil supply passage. This is accomplished by the provision of a novel oil pressure control apparatus, in which a control valve has a bypass passage for bypassing the control valve. An oil pressure regulating valve is provided to allow a small amount of oil to flow to the engine valve driving apparatus, even when the control valve is in its closed position, at the same time preventing the bypassed oil from interfering with the operating pressure of the hydraulic actuator. In this inventive apparatus, the hydraulic actuator rapidly engages in operation when the control valve shifts from the closed to the open position. In systems where the operating oil supply passage also serves as a lubricating oil supply passage, lubricating oil pressure is available, even when the control valve is in the closed position.

Other objects, advantages, and features of the invention will become apparent from the following detailed description of a preferred embodiment, taken in conjunction with the accompanying drawings.

DETAILED DESCRIPTION OF THE PREFERRED EMBODIMENT

FIGS. 1–9 show a preferred embodiment, in which an engine valve driving apparatus is provided with the novel oil pressure control apparatus of the present invention. This engine valve driving apparatus is similar to the apparatus disclosed in nonpublished Japanese Application No. 61-186246, filed Aug. 8, 1986, and U.S. patent application Ser. No. 082,621, filed Aug. 7, 1987, owned by assignee and now U.S. Pat. No. 4,794,893.

Multi-cylinder engine 1 is of a V-8 configuration. It has two intake valves, two exhaust valves (not shown) for each cylinder 1, 2, etc., and a pair of cam shafts 14

(only one being shown) rotatably supported on cylinder head 13 by bearing portions 13*a*.

Figure 1:
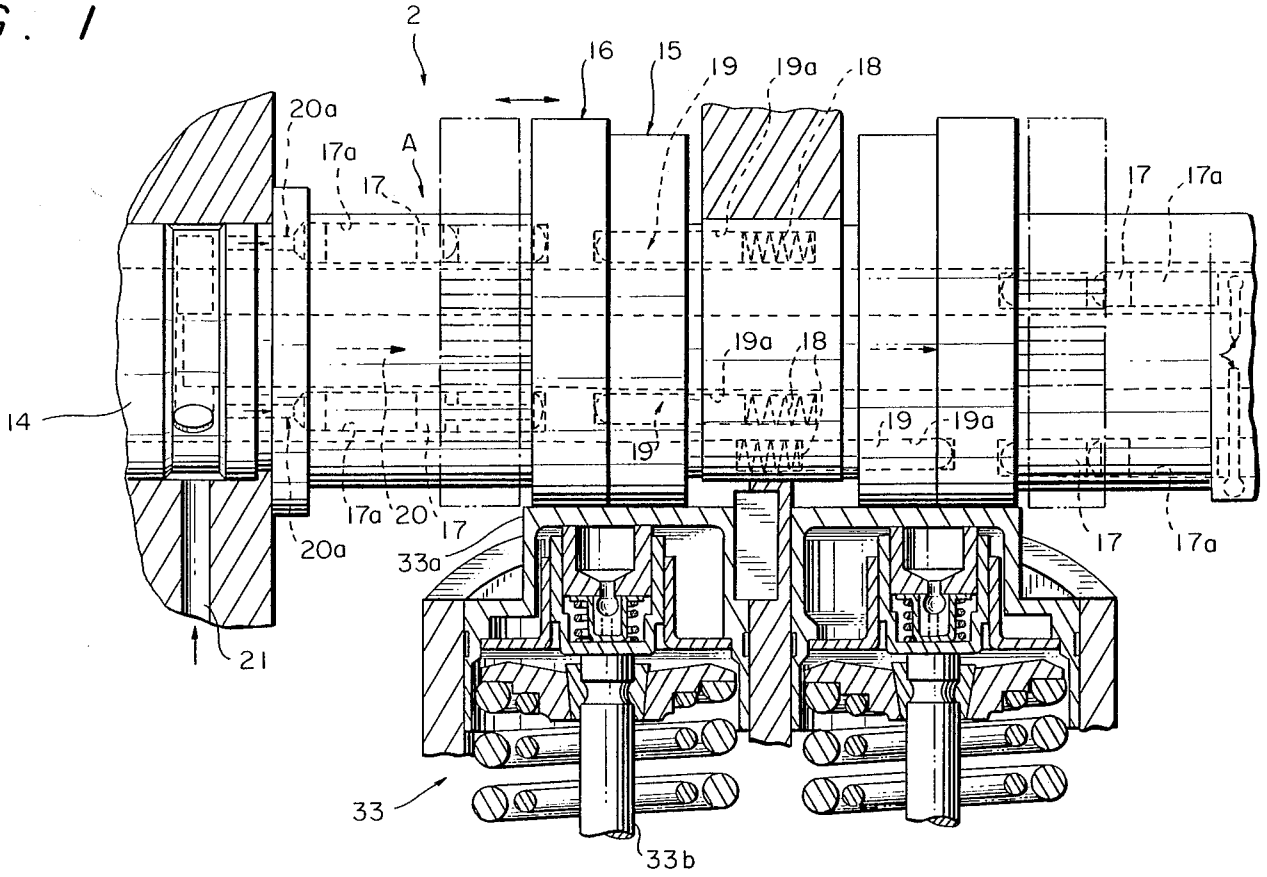
FIG. 1 is a side view of a portion of the inventive engine valve driving apparatus.
Figure 2:
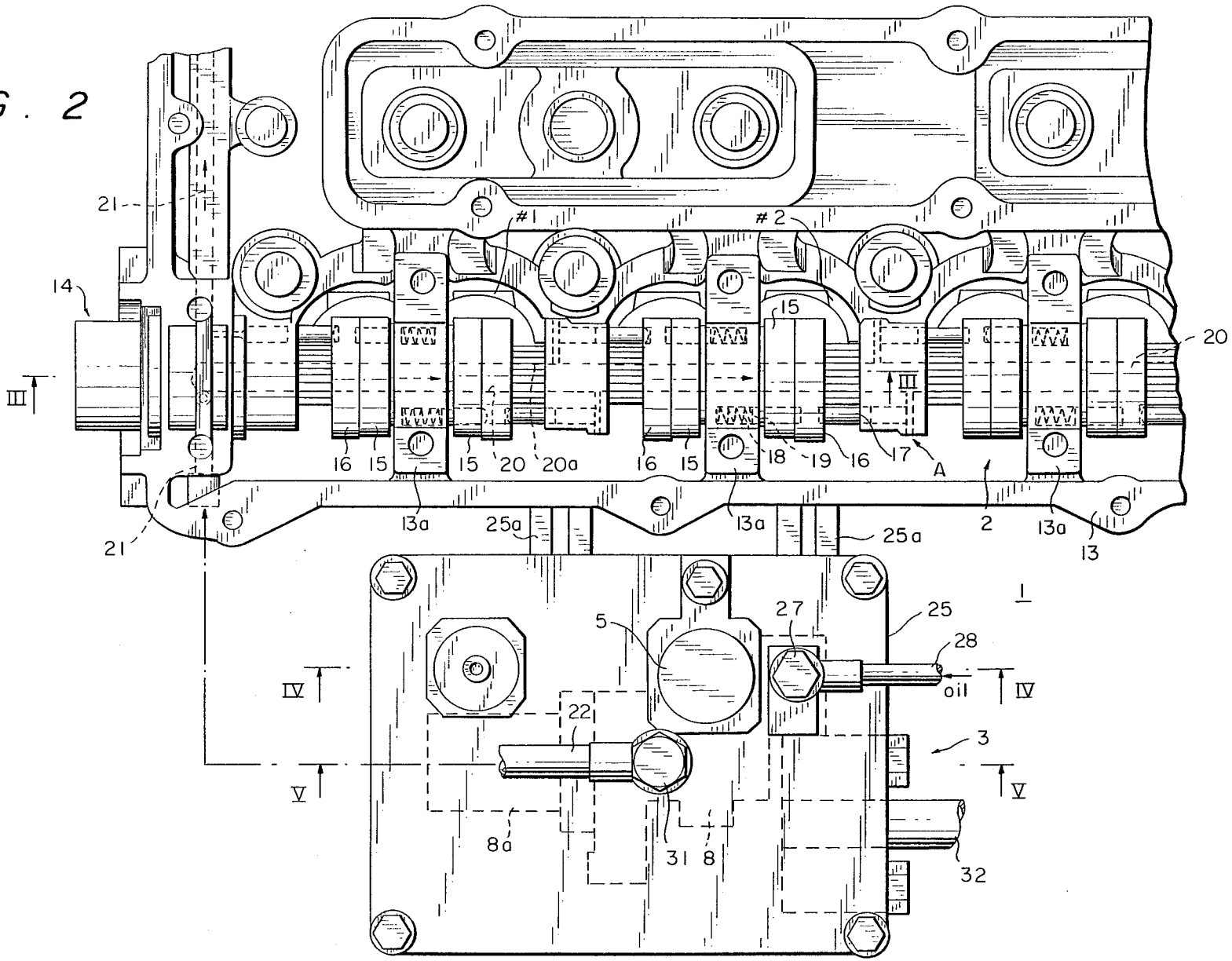
FIG. 2 is a top plan view of the inventive engine valve driving apparatus of the invention.
Figure 3:
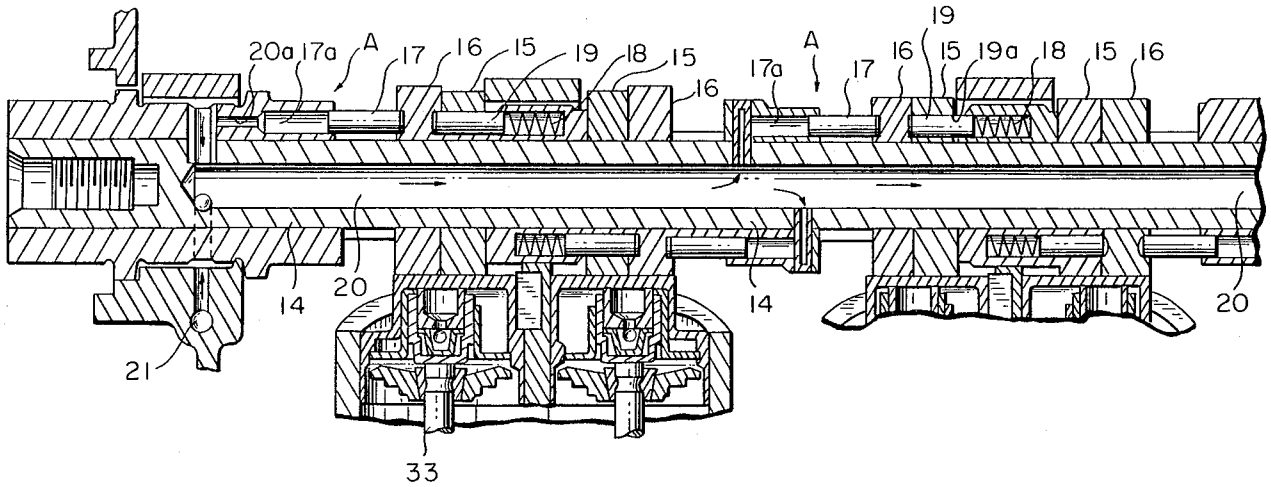
FIG. 3 is a cross-sectional side view taken along line III—III of FIG. 2.
Figure 4:
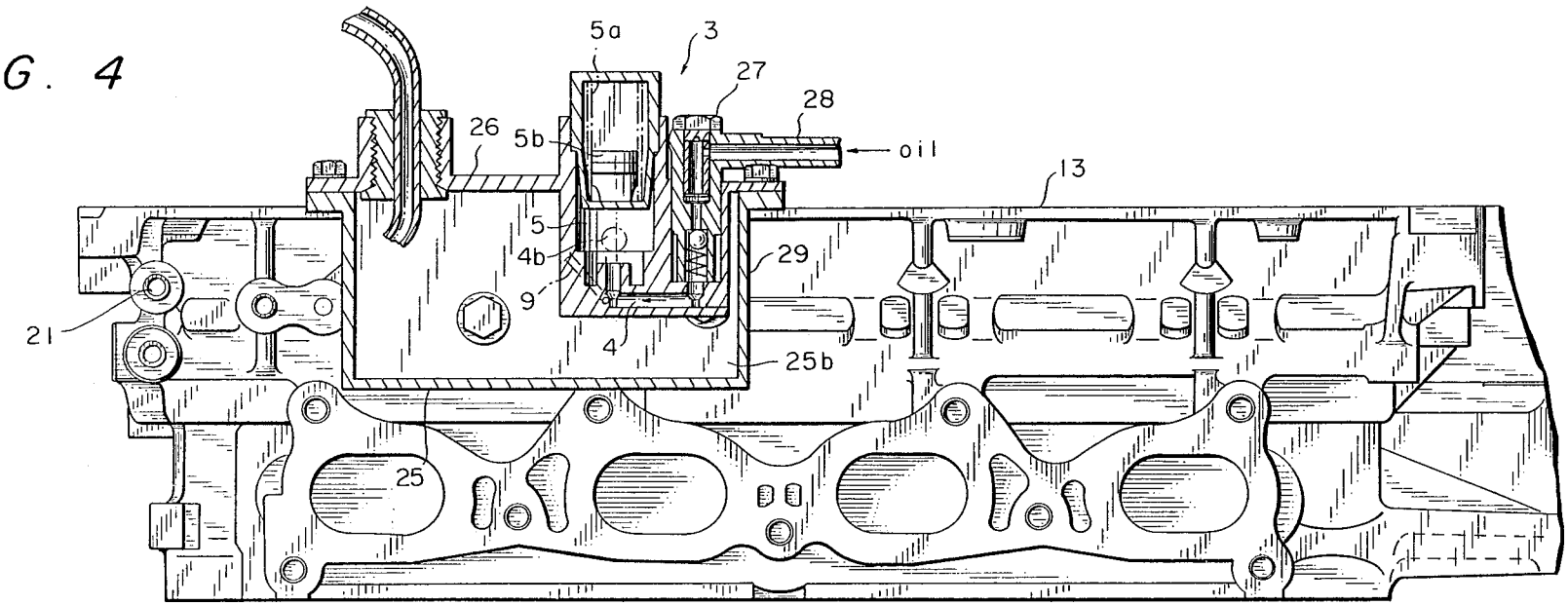
FIG. 4 is a side view, partially in cross-section, taken along line IV—IV of FIG. 2.
Figure 5:
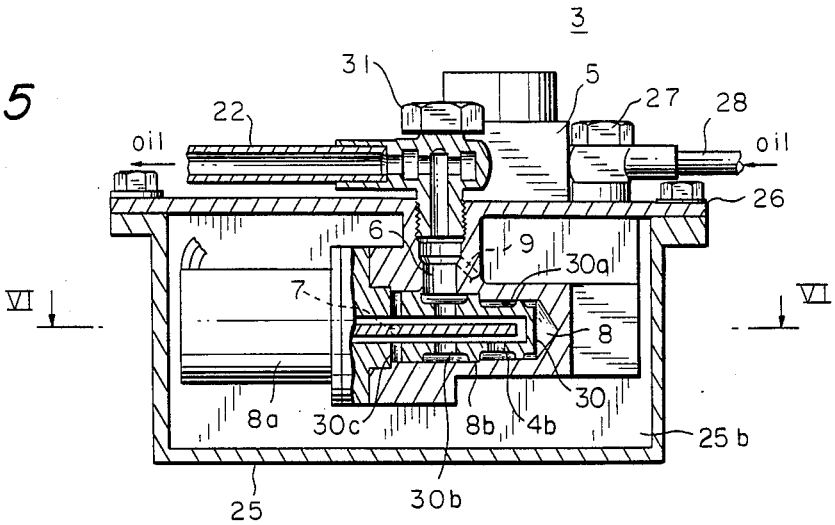
FIG. 5 is a cross-sectional side view taken along line V—V of FIG. 2.
Figure 6:
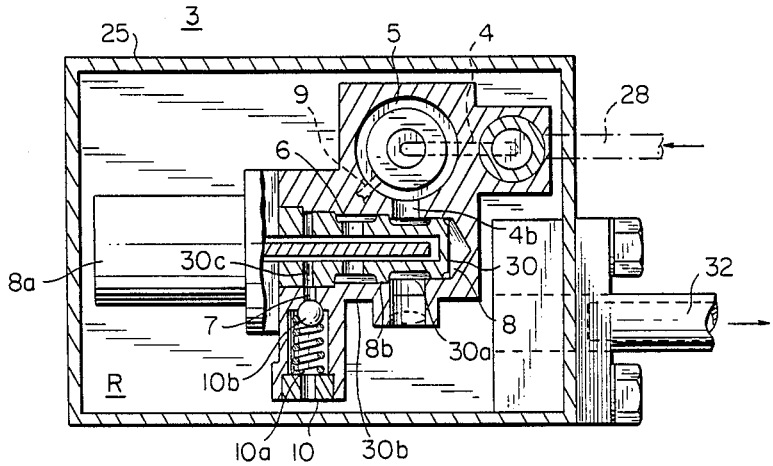
FIG. 6 is a cross-sectional top view taken along line VI—VI of FIG. 5.

As shown in FIG. 1, low speed cams 15 and high speed cams 16 are mounted on cam shaft 14. Each intake or exhaust port of the engine requires a valve, and a pair of cams 15, 16 operate each valve. Since all valves and cams are of the same structure, only one valve and its associated operating cams will be described herein.

Low speed cam 15 has a smaller cam profile than high speed cam 16, and both are fixed to rotate with cam shaft 14. High speed cam 16 slidably fits onto cam shaft 14 and is adapted to be shifted axially relative to cam shaft 14 by a spline joint. Engine valve 33 is positioned beneath and in operative relationship to cams 15 and 16 and is provided with a tappet 33*a*, which engages continuously with cam 15 and intermittently with cam 16. Located below the tappet 33*a* is valve stem 33*b* having a valve head at its lower end to control a port to the combustion chamber of a cylinder.

FIGS. 1, 2, 3, and 9 show a valve driving apparatus which operates in cooperation with hydraulic actuator A for controlling the axial shifting or movement of high speed cam 16. Actuator A includes: a plunger 17 disposed in an oil pressure chamber 17*a*, common oil supply passage 20 and oil supply passage 20*a* extending therefrom formed in cam shaft 14, counter plunger 19 provided in bore 19*a*, and a return spring 18 biasing plunger 19. The oil supply passage 20 is connected to an oil pressure control apparatus 3 at an end portion of cam shaft 14 through line 22 and passage 21.

When the engine is driven at a low speed range, oil pressure in the oil pressure chamber 17*a* is kept at about 0.8 kg/cm$^2$ by oil pressure control apparatus 3 so that engine valve 33 is driven only by the low speed cam 15, the high speed cam 16 being shifted by the bias of spring 18. When the engine is driven at a high speed range, operating oil from the oil pump is fed directly to the oil pressure chamber 17*a* through oil supply passages 20, 20*a*. Oil pressure is thereby raised above 2.0 kg/cm$^2$ so that plunger 17 is forced toward cam 16, shifts the cam 16 from an inoperative to operative position, and engine valve 33 is driven by the high speed cam.

Figure 10:
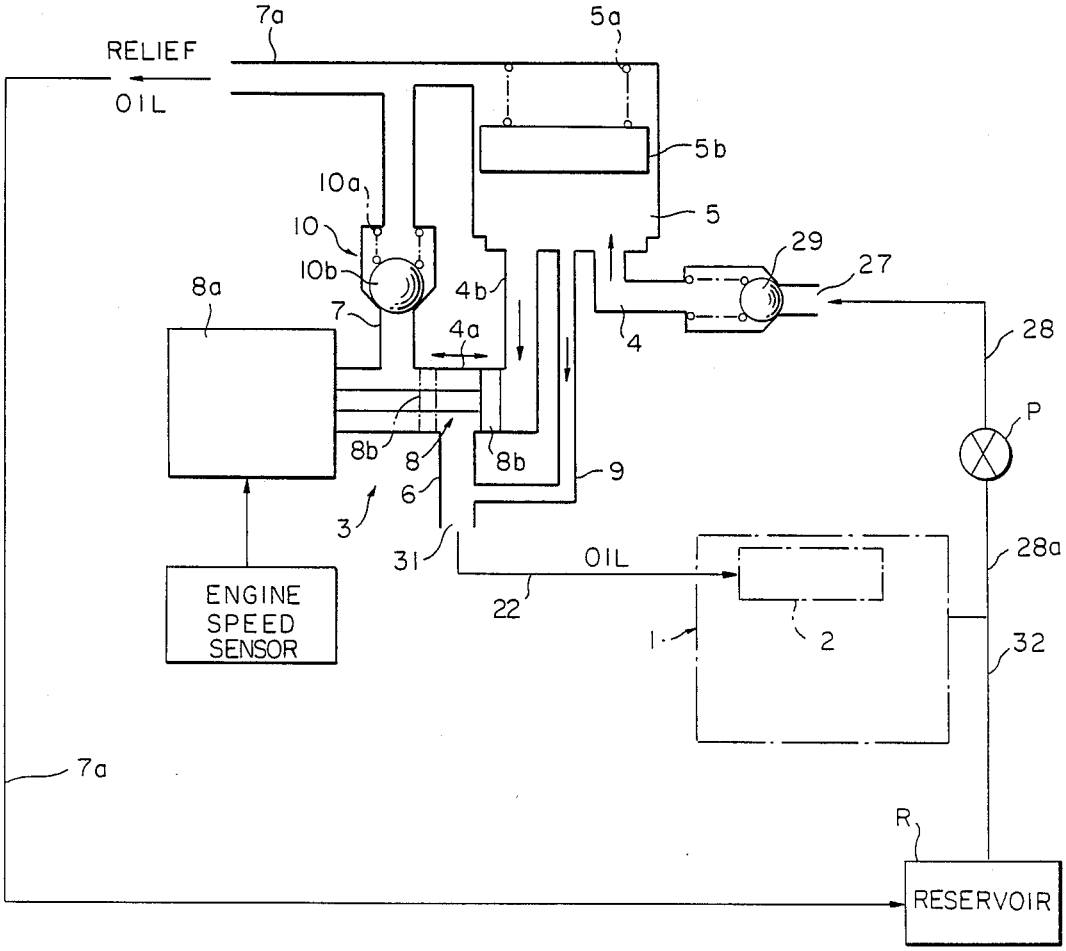
FIG. 10 is a schematic of the hydraulic circuit of the invention.

FIG. 10 shows a schematic for the novel hydraulic circuit for an internal combustion engine valve driving apparatus. Engine 1 has valve driving apparatus 2, which includes hydraulic actuators A as previously described. Oil from the oil pump P, taken from line 32 leading from reservoir R, is fed to the engine valve driving apparatus 2 through pressure control apparatus 3. Oil from pump P is fed through conduit 28 to the port of fitting 27. Ball check valve 29, which allows oil into—but not out of—passage 4, establishes a predetermined hydraulic pressure of greater than 2.0 kg/cm$^2$ in accumulator 5. Passage 4 connects with accumulator 5, while passage 4*b* leads from accumulator 5 to control valve 8. Passage 6 leads from control valve 8 to valve driving apparatus 2 in engine 1 via fitting 31 and conduit 22. Conduit 28*a* leads from valve driving apparatus 2 to pump P.

Piston 5*b* is mounted in accumulator 5 for reciprocation and is biased or urged by spring 5*a* downwardly against the oil in the accumulator. Passage 7 connects control valve 8 with a one-way pressure relief valve 10. Hydraulic pressure relieved by valve 10 is returned to reservoir R by line 7*a*. Valve 10 includes a ball element 10*b* urged against a valve seat by spring 10*a* to establish a predetermined relief value of 0.7 kg/cm$^2$, which is substantially lower than the predetermined pressure value of 2.0 kg/cm$^2$ required to actuate hydraulic actuators A. A small diameter bypass line 9 connects accumulator 5 with passage 6, thereby bypassing control valve 8.

Control valve 8 comprises a spool element 8*b* driven by actuator 8*a*, which is preferably an electric actuator. Spool element 8*b* essentially has two positions. One is a shown in solid lines in FIG. 10, wherein passage 4*b* is blocked and passage 6 is connected to passage 7. In this position, since passage 6 receives oil at the higher pressure via bypass 9, the connection to passage 7 relieves the higher pressure to the lower pressure, which is passed to valve driving apparatus 2. The second position is shown in dotted lines in FIG. 10, wherein passage 7 is blocked and passages 4*b* and 6 are connected, allowing the higher pressure to be passed to valve driving apparatus 2.

Referring to FIGS. 2 and 4 through 6, oil pressure control apparatus 3 has a casing 25, which is fixed to a side surface of the cylinder head 13 by stays or brackets 25, 25*a*. A cover plate 26 closes casing 25 and supports a fitting 27 connected to a conduit 28 which, in turn, is connected to oil pump P. Control valve 8 is mounted within casing 25 suspended from cover 26. Electric actuator 8*a* is mounted on the control valve body and is operatively connected to valve element 8*b* by means of a shiftable sleeve or spool.

Conduit 28 carries oil from pump P and is connected to fitting 27, which is supported by cover 26. Fitting 27 includes one-way ball check valve 29 having a ball element biased by a spring to effect the higher pressure. Fitting 27 also defines accumulator 5 and passage 4 leading horizontally from the bottom of valve 29 to a vertical inlet to accumulator 5.

Within accumulator 5, piston 5*b* is biased by spring 5*a* for vertical reciprocation. Passage 4*b* extends horizontally and connects accumulator 5 with one end of control valve 8. Passage 6 extends vertically from an intermediate position of control valve 8 through fitting 31 carried by cover 26 and connects with conduit 22 leading to passage 21 in cylinder head 13. Bypass conduit or channel 9 is defined by the block of fitting 27 and connects passage 6 with passage 4*b*, where it meets with control valve 8. Passage 7 leads from the other end of control valve 8 through relief valve 10 into the space within casing 25 which serves as the reservoir R.

Figure 7:
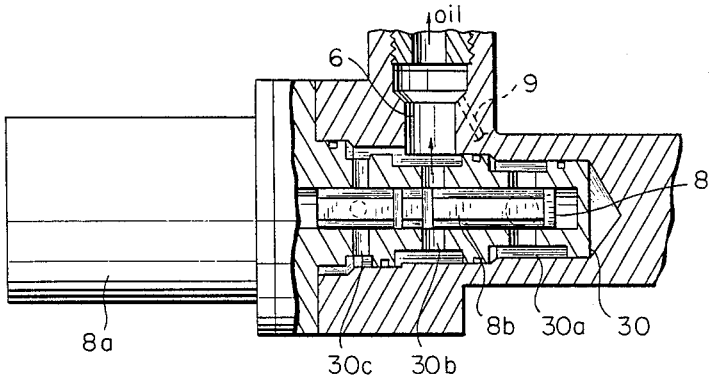
FIG. 7 is a cross-sectional view of the novel control valve in the closed position.
Figure 8:
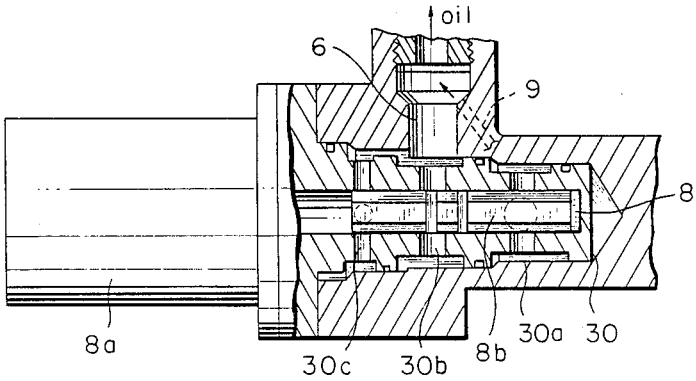
FIG. 8 is a cross-sectional view of the novel control valve in the open position.

Referring now to FIGS. 7 and 8, valve element or body 8*b* of the control valve 8 is shown in the form of a sleeve 30 mounted for axial shifting or movement within valve 8. Sleeve 30 defines an inlet portion 30*a* connected to the passage 4*b*, an outlet port 3*b* connected via passage 6 to the oil supply passage 20 in the cam shaft 14, and a relief port 30*c* connected via passage 7 to the chamber of the casing 25, which serves as reservoir R. Outlet port 30*b* is connected to oil supply passage 21 of the cylinder head 13 through oil supply passage 6, connector or fitting 31, and an outlet pipe 22. Return pipe 32 connects the chamber of the casing 25 to pump P directly or via an oil pan. Bypass oil passage 9 has a smaller diameter than that of oil supply passage 4 and bypasses the control valve 8 to continuously supply oil to oil supply passage 6.

Figure 9:
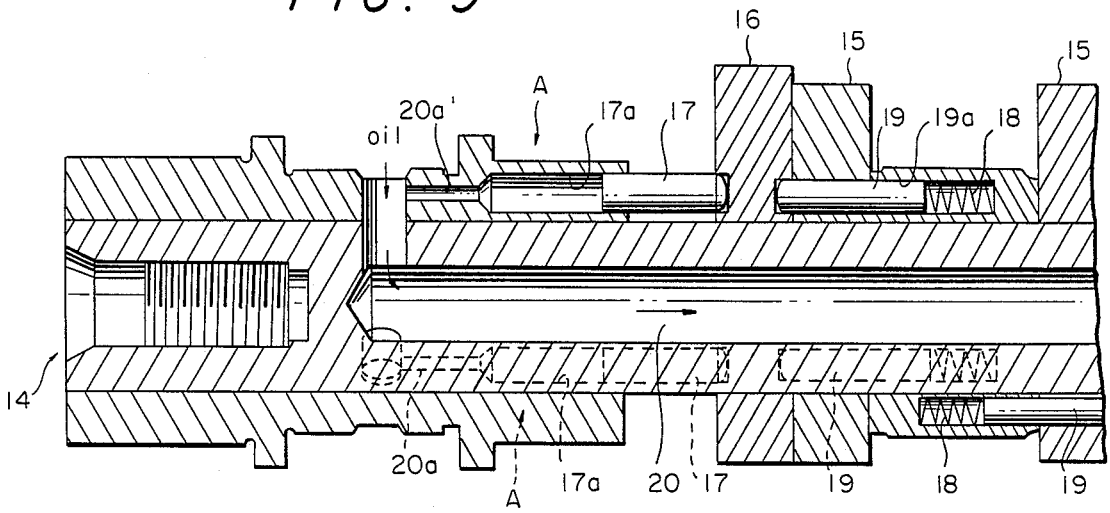
FIG. 9 is a cross-sectional side view of a cam shaft unit.

When the engine is driven in a high speed range, an engine speed sensor sends an appropriate signal to actuator 8*a*. Actuator 8*a* then moves the valve body 8b toward the left, as shown in FIG. 8, placing inlet port 3*a* and outlet port 30*b* in communication and thereby connecting the oil supply passage 4 and the oil supply passage 6. When the engine is driven in a low speed range, the engine speed sensor sends an appropriate signal to actuator 8a, and actuator 8a moves body 8b toward the right, as shown in FIG. 9. Outlet port 30b and relief port 30c are in communication, thereby connecting oil supply passage 6 and relief oil passage 7.

As shown in FIGS. 1 through 10, when the engine is driven in a low speed range, valve body 8b is shifted so that oil from the oil pump is fed to the oil supply passage 6 only through bypass oil passage 9. Even though oil passages 20, 21 are filled with oil, the oil pressure in the oil pressure chamber 17a will not rise above 0.7 kg/cm$^2$ by virtue of relief valve 10 being in communication with passage 6 via valve 8. The high speed cam 16 is forced into its inoperative position by return spring 18, and valve 33 is driven only by low speed cam 15. Relief oil from the relief valve 10 is returned to the oil pan or pumped through the chamber of the casing 25 and the return pipe 32. Further, since oil pressure changes in accordance with the engine RPM, one-way valve 29 mounted in the fitting or connector 27 prevents backflow of oil in the accumulator 5, even if the engine speed decreases.

When engine speed increases to a high speed range, actuator 8a moves valve body 8b to the opened position, and the plunger 17 forces, by oil pressure directly applied from the accumulator 5 and the oil pump, the high speed cam 16 to axially slide into its operative position, and valve 33 is driven by the high speed cam 16. In this embodiment, oil inlet pipe 28 is connected to an upper portion of the oil pressure control apparatus 3 in order not to introduce air from the oil pump.

Figure 11:
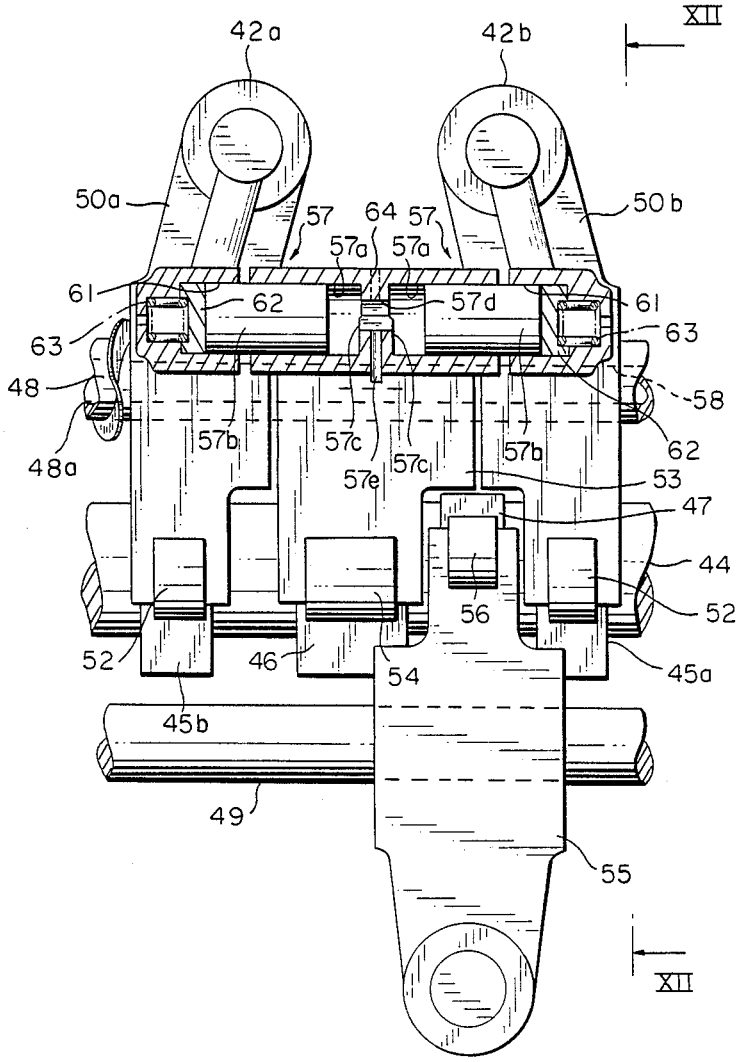
FIG. 11 is a top plan view of an engine valve driving apparatus showing another embodiment of the invention.
Figure 12:
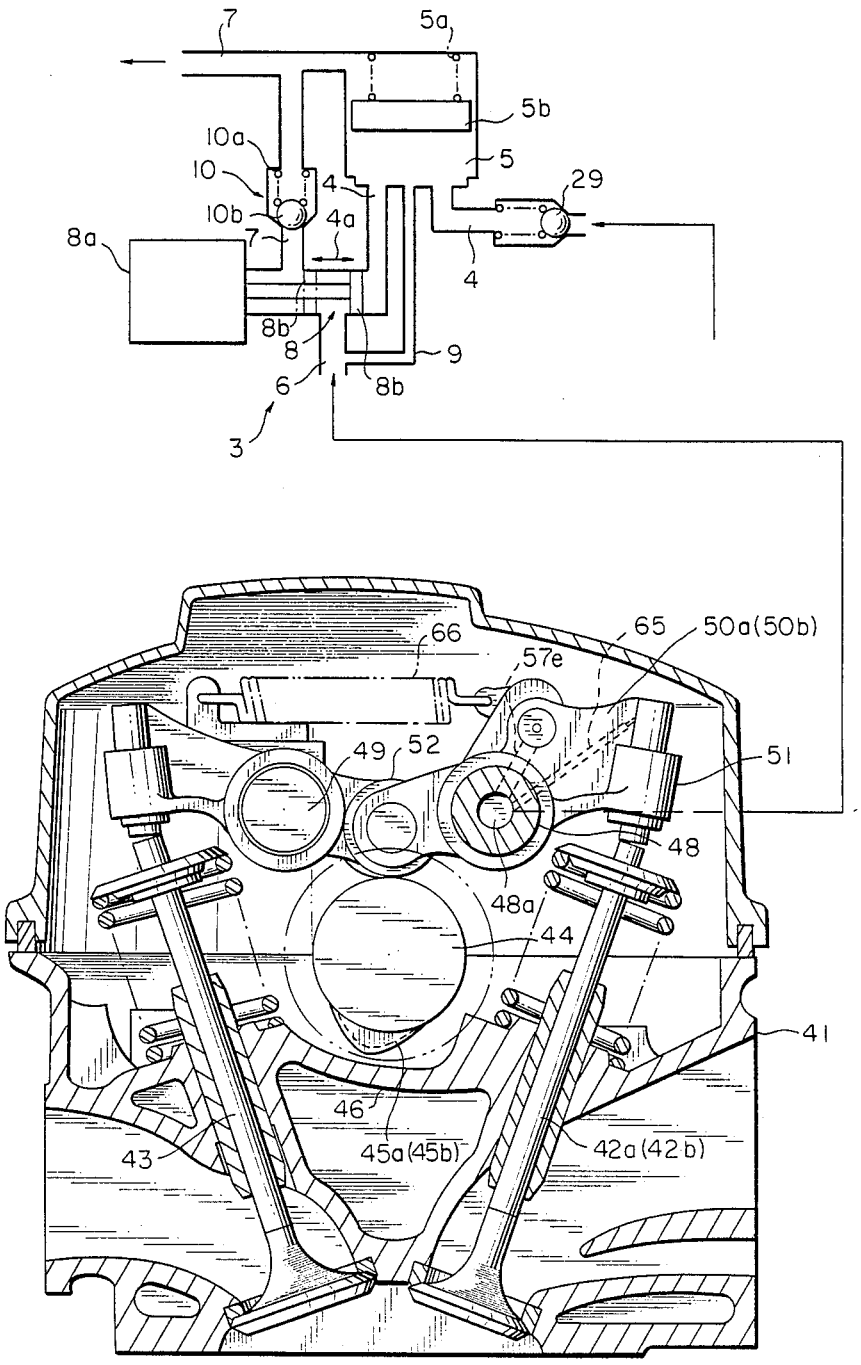
FIG. 12 is a side view taken along line XII—XII of FIG. 11, upon which a schematic of the hydraulic circuit has been imposed.

Another embodiment is shown in FIGS. 11 and 12, where the engine valve driving apparatus is a rocker arm type apparatus, as proposed by nonpublished Japanese Application No. 61-24684, filed Oct. 16, 1986, in the name of assignee. In FIGS. 11 and 12, one cylinder of an internal combustion engine is shown having a plurality of cylinders and a cylinder head 41. Each cylinder has two intake valves 42a and 42b for opening and shutting, respectively, intake ports and one exhaust valve 43 for discharging exhaust gas from the cylinder.

Above cylinder head 41, a cam shaft 44 is mounted between the intake valves 42a, 42b and the exhaust valve 43. Cam shaft 44 has mounted thereon in spaced relation one pair of low speed cams 45a, 45b and a high speed cam 46 located substantially in the center of the spacing between low speed cams 45a and 45b. The high speed cam 46 has a cam lobe which is larger than that of the low speed cams 45a and 45b. The high speed cam 46 provides greater cam lift and allows the cam to remain open longer than the low speed cams 45a and 45b. A cam 47 for driving the exhaust valve 43 is provided between low speed cam 45b and high speed cam 45.

A rocker shaft 48 is mounted on the side of intake valves 42a and 42b parallel to the cam shaft 44. A rocker shaft 49 is mounted on the side of the exhaust valve 43b parallel to the cam shaft 44. Rocker arms 50a and 50b drive intake valves 42a and 42b, respectively, and are pivotally mounted on the rocker shaft 48. Rocker arms 50a and 50b are disposed to engage with the stems of the intake valves 42a, 42b, respectively, at one end thereof and, at the other end, to engage with low speed cams 45a and 45b, respectively. At one end of each rocker arms 50a and 50b, a hydraulic lash adjustor 51 is provided so that the end of each rocker arms 50a and 50b engages with the stem of its associated intake valves 42a and 42b, without any lash therebetween. At the other end of each of rocker arms 50a and 50b are roller cam followers 52 for reducing sliding friction between the associated end of each of rocker arms 50a, 50b and low speed cams 50a, 50b. An oil passage 48a is formed in rocker shaft 48 for feeding oil from the oil pressure control apparatus 3 to the hydraulic lash adjustor 51, the lubricated parts, and an hydraulic actuator (explained below).

Reference numeral 65 designates an oil passage in communication with oil passage 48a for feeding oil to the hydraulic lash adjustor 51. Rocker arm 53 is mounted for transmitting the movement of the high speed cam 46 to the respective rocker arms 50a and 50b and is pivotally mounted on the rocker shaft 48 at substantially the center position between the rocker arms 50a and 50b. Arm 53 is engaged with the high speed cam 46 at one end thereof. A spring 66 is mounted for pressing the end of the rocker arm 53 against the high speed cam 46 and preventing the rocker arm 53 from hitting the high speed cam 46 at low engine rpm. At the end of the rocker arm 53, there is provided a roller arm follower 54 for reducing sliding friction between the end of the rocker arm 53 and the high speed cam 46. The axial length of roller cam follower 54 is larger than that of roller cam follower 52. Moreover, a rocker arm 55 for transmitting the movement of the cam 47 for driving the exhaust tappet 43 connected to the exhaust valve 43 is pivotally mounted on the rocker shaft 44 and has at one end thereof a roller cam follower 56 for reducing sliding friction between the end of the rocker arm 55 and the cam 47.

A pair of hydraulic actuators 57 releasably connect the rocker arms 50a and 50b and the rocker arm 53. Each of the actuators 57 comprises a cylinder bore 57a formed integrally in the rocker arm 53, a plunger 57b slidable in each cylinder bore 57a, and an oil pressure chamber 57c formed by the cylinder bore 57a and the plunger 57b. Wall 57d separates the oil pressure chamber 57c of one actuator 57 from that of the other. An oil passage 57e for feeding oil to the oil pressure chambers 57c feeds into wall 57d and opening 64 therein. The oil passage 57e communicates with the oil passage 48a formed in the rocker shaft 48. Preferably, oil passage 57e is formed by a drill to be oblique toward the upstream direction of the oil passage 48a, so that oil can be easily introduced into the oil pressure chamber 57c.

Bores 61 for receiving the plungers 57b are formed integrally in the respective rocker arms 50a and 50b. Relatively sliding end walls 62 of the respective bores 61 provide surfaces for respective plungers 57b to abut and engage. In each of the bores 61, there is a spring 63 which biases the plunger 57b outwardly through the slidable end wall 62. At low engine speed, oil pressure in the oil pressure chamber 57c is kept low by oil pressure control apparatus 3. The plungers 57b are forced toward each other, retracting from bores 61 under the urging or bias of springs 63. At this time, plungers 57b lie entirely within cylinder bores 57a. The rocker arm 53 is disengaged from the rocker arms 50a and 50b.

On the other hand, at high engine speed, oil pressure in the oil pressure chamber 57c will be high as received from the oil pressure control apparatus 3. The plungers 57b will be pushed away from each other and into the bores 61 of the rocker arms 5a and 50b against the force of springs 63. The rocker arm 53 will be engaged with the rocker arms 50a and 50b. An air relief passage for the oil pressure chamber 57c of the rocker arm 53 is provided to relieve the air in the oil pressure chamber 57*c*.

According to the above-described embodiment, since the rocker arm 53 is not engaged with the rocker arms 50*a* and 5*b* at low engine speed, the movement of the low speed cams 45*a* and 45*b* is transmitted to the intake valves 42*a* and 45*b* by the rocker arms 50*a* and 50*b*, and the intake valves 45*a* and 45*b* are driven by the low speed cams 45*a* and 45*b*. On the other hand, at high engine speed, since the rocker arm 53 is engaged with the rocker arms 50*a* and 50*b*, the movement of the high speed 4*b* is transmitted to the intake valves 42*a* and 42*b* through the rocker arm 53 and the rocker arms 50*a* and 50*b* and the intake valves 42*a* and 42*b* are driven by the high speed cam 46.

In this embodiment shown in FIGS. 1 and 12, oil passage 57*e* is communicated to both the lubricated portion of the engine valve driving mechanism and the hydraulic lash adjustor 51, even if the control valve 8 is in the closed position, oil pressure still exists for feeding oil to the hydraulic lash adjustor and the lubricated parts.

The present invention has been shown and described with reference to specific embodiments. However, it should be noted that the present invention is in no way limited to the details of the described arrangements, but changes and modifications may be made without departing from the scope of the appended claims. For example, the novel oil pressure control apparatus can be used with the engine valve driving system as a means of providing a stopping function.

I claim:

1. An oil pressure control apparatus for an internal combustion engine, comprising:

a pump;

hydraulic actuator means for actuating an element of the engine when receiving operating oil from the pump supplied thereto above a predetermined pressure;

an oil supply passage for supplying oil from said pump to the hydraulic actuator means; and control valve means interposed in said oil supply passage for controlling the pressure of operating oil supplied to the hydraulic actuator means in accordance with engine operating conditions, said control valve means including a relief oil passage, a bypass oil passage for bypassing the control valve means and connecting the pump to the hydraulic actuator means, an oil pressure regulating valve provided in the relief oil passage for relieving the oil pressure to below the predetermined value, and a valve member between a first position, wherein operating oil from the pump is supplied only through the bypass oil passage and pressure of the operating oil supplied to the hydraulic actuator means is relieved to below the predetermined value, and a second position, wherein operating oil from the oil pump is supplied through the valve member to the hydraulic actuator means directly at a pressure above the predetermined pressure; wherein said valve member in the first position connects the relief oil passage to the bypass so that the operating oil from the pump is relieved, regulated by the oil pressure regulating valve, through the bypass oil passage and the relief oil passage, and said valve member in the second position closes the relief oil passage and destroys the oil pressure regulating valve.

2. The oil pressure control apparatus of claim 1, wherein said oil pressure regulating valve comprises a ball check valve.

3. The oil pressure control apparatus of claim 1, wherein the control valve means includes a one-way check valve upstream of the valve member.

4. The oil pressure control apparatus of claim 3, wherein the control valve means includes an accumulator between the one-way check valve and the valve member.

5. The oil pressure control apparatus of claim 2, further comprising the hydraulic actuator means cooperating with an intake or exhaust valve of a cylinder of the engine for controlling rate of opening and duration of opening of the intake or exhaust valve, said hydraulic actuator means comprising two cams of different shapes, one of which is effective at low speed and the other of which is effective at high speed, the two cams being selectively placed into driving relation with the intake or exhaust valve, and hydraulic actuator control means for selectively placing one of said cams into driving relation with the intake or exhaust valve in response to operating oil pressure imposed on the hydraulic actuator means.

6. An oil pressure control apparatus for an internal combustion engine, comprising:

a pump, hydraulic actuator means for actuating an element of the engine when receiving operating oil from the pump supplied thereto above a predetermined pressure, an oil supply passage for supplying oil from said pump to the hydraulic actuator means, control valve means interposed in said oil supply passage for controlling the pressure of operating oil supplied to the hydraulic actuator means in accordance with engine operating conditions, said control valve means including a relief oil passage, a bypass oil passage for bypassing the control valve means and connecting the pump to the hydraulic actuator means, an oil pressure regulating valve provided in the relief oil passage for relieving the oil pressure to below the predetermined value, and a valve member movable between a first position, wherein operating oil from the pump is supplied only through the bypass oil passage and pressure of the operating oil supplied to the hydraulic actuator means is relieved to below the predetermined value and a second position, wherein operating oil from the oil pump is supplied through the valve member to the hydraulic actuator means directly at a pressure above the predetermined pressure, said control valve means including a ball check valve, said hydraulic actuator means cooperating with an intake or exhaust valve of a cylinder of the engine for controlling rate of opening and duration of opening of the intake or exhaust valve, said hydraulic actuator means comprising two cams of different shapes, one of which is effective at low speed and the other of which is effective at high speed, the two cams being selectively placed into driving relation with the intake or exhaust valve, and hydraulic actuator control means for selectively placing one of said cams into driving relation with the intake or exhaust valve in response to operating oil pressure imposed on the hydraulic actuator means.

7. The oil pressure control apparatus of claim 6, wherein the hydraulic actuator means further includes a first rocker arm having a portion engaged to drive the intake or exhaust valve and being driven by the low speed cam, a second rocker arm driven by the high speed cam, and hydraulic coupling means to couple the first and second rocker arms.

8. The oil pressure control apparatus of claim 7, wherein the hydraulic coupling means includes chamber means formed in each of the first and second rocker arms, a pin slidably mounted in said chamber means sliding being a first position coupling said chamber means during said pin to its second position, and oil supply means for supplying oil at a pressure sufficient to slide said pin to its first position.

9. The oil pressure control apparatus of claim 8 further comprising a hydraulic lash adjustor provided in the first rocker arm and said oil supply means supplying oil to the hydraulic lash adjustor.

10. The oil pressure control apparatus of claim 8 further comprising air relief means for relieving air from said chamber means.

11. An oil pressure control apparatus for driving an engine intake or exhaust valve of a cylinder of an internal combustion engine, said apparatus comprising:

a cam shaft means for rotating in synchronism with rotation of a crankshaft of an engine, a low speed cam having a lift lobe fixed on said cam shaft to rotate therewith, a high speed cam having a lift lobe higher than the lift lobe of the low speed cam's aid high speed cam mounted on the camshaft means to rotate therewith and for axial movement between an operative and inoperative position, hydraulic actuator means for axially shifting the high speed cam between its operative position, wherein the high speed cam is in driving relation with the intake or exhaust valve and its inoperative position out of driving relation with the intake or exhaust valve, said hydraulic actuator means having an oil pressure chamber with a plunger sliding therein for shifting the high speed cam to its operative position when oil pressure in the oil pressure chamber is above a predetermined value and a return spring for returning the high speed cam to its inoperative position when oil pressure in the oil pressure chamber is below the predetermined value, an oil pump for supplying operating oil to the oil pressure chamber, an oil supply passage means connecting the oil pump to the oil pressure chamber for supplying operating oil normally at an oil pressure above the predetermined value, control valve means having an open and a closed position interposed in the oil supply passage means for controlling the pressure of the operating oil in accordance with engine speed, engine speed sensing means for sensing engine speed and moving the control valve means between its open and closed positions in response thereto, bypass oil passage means for bypassing the control valve means and supplying a small quantity of operating oil from the oil pump to the oil pressure chamber, even when the control valve means is in its closed position, and relief oil passage means for relieving pressure to below the predetermined value from the oil supply passage means when the control value means is in its closed position.

12. An oil pressure control apparatus as claimed in claim 11, wherein said control valve means has a valve member movable between a first position cutting of operating oil being supplied from the oil pump and communicating with the oil supply passage means and the relief oil passage means to relieve the operating oil by passing the control valve means to a pressure below the predetermined value and a second position, wherein operating oil being supplied form the oil pump is passed through the control valve means.

13. The oil pressure control apparatus of claim 11, wherein the oil supply passage means includes accumulator means upstream of the control valve means for accumulating operating oil at an oil pressure above the predetermined value and a one-way valve upstream said accumulator means for setting the oil pressure of the operating oil above the predetermined value.

14. An oil pressure control apparatus for driving a valve of an internal combustion engine, comprising:

cam shaft means located over a cylinder head of the engine for driving cams, a low speed can fixed to rotate with the cam shaft means, a high speed cam mounted to rotate with the cam shaft means, first rocker arm means for operating the valve of the internal combustion engine driven by said low speed cam, second rocker means driven by said high speed cam, oil pressure chamber means formed in each of said first and second rocker arms, a pin slidably received in the oil pressure chamber means sliding between a first position coupling said rocker arms and a second position decoupling said rocker arms, a return spring for urging the pin to decouple the rocker arms, an oil pump for supplying operating oil, an oil supply passage for connecting the oil pump to the oil pressure chamber means, control valve means for controlling the pressure of the operating oil in accordance with an engine operating condition, a relief oil passage for relieving pressure to below the predetermined value from the oil supply passage, a bypass oil passage by bypassing the control valve means and supplying a small quantity from the oil pump to the oil pressure chamber, and sensing means for sensing an engine operating condition and, in response thereto, controlling the control valve means for regulating the oil pressure of the operating oil to below the predetermined value when the condition sensed is a first preselected value and for regulating the oil pressure of the operating oil to above the predetermined value when the condition sensed is a second preselected value, said control valve means connecting the relief oil passage to the bypass oil passage so that the operating oil from the pump is regulated by an oil pressure regulating valve interposed in said relief oil passage when the condition sensed is the first preselected value, and said control valve means closes the relief oil passage and destroys the oil pressure regulating valve when the condition sensed is the second preselected value.

15. An oil pressure control apparatus as claimed in claim 14, wherein the control valve means is movable between a first position, wherein operating oil from the oil pump is supplied only through the bypass oil passage to the oil pressure chamber means and pressure of the operating oil is regulated to below the predetermined value by relieving the pressure of the oil supplied through the bypass oil passage, the relieved portion being returned to the collecting point, and a second position, wherein operating oil from the oil pump is supplied to the oil pressure chamber means through the control valve means and the pin is shifted to couple said rocker arms, and wherein a rocker shaft is provided on which said rocker arms are mounted for rocking, and said oil supply passage includes a rocker shaft passage defined by the rocker shaft which is connected to the oil pressure chamber means and oil in said rocker shaft passage serves for lubrication.

16. An oil pressure apparatus for driving a valve of an internal combustion engine, comprising:

cam shaft means located over a cylinder head of the engine for driving cams, a low speed cam fixed to rotate with the cam shaft means, a high speed cam mounted to rotate with the cam shaft means, first rocker arm means for operating the valve of the internal combustion engine driven by said low speed cam, second rocker means driven by said high speed cam, oil pressure chamber means formed in each of said first and second rocker arms, a pin slidably received in the oil pressure chamber means sliding between a first position coupling said rocker arms and a second position decoupling said rocker arms, a return spring for urging the pin to decouple the rocker arms, an oil pump for supplying operating oil, an oil supply passage for connecting the oil pump to the oil pressure chamber means, control valve means for controlling the pressure of the operating oil in accordance with an engine operating condition, a bypass oil passage by bypassing the control valve means and supplying a small quantity from the oil pump to the oil pressure chamber, sensing means for sensing an engine operating condition and, in response thereto, controlling the control valve means for regulating the oil pressure of the operating oil to below the predetermined value when the condition sensed is a first preselected value and for regulating the oil pressure of the operating oil to above the predetermined value when the condition sensed is a second preselected value, said control valve means being movable between a first position, wherein operating oil from the oil pump is supplied only through the bypass oil passage to the oil pressure chamber means and pressure of the operating oil is regulated to below the predetermined value by relieving the pressure of the oil supplied through the bypass oil passage, the relieved portion being returned to the collecting point, and a second position, wherein operating oil from the oil pump is supplied to the oil pressure chamber means through said control valve means and the pin is shifted to couple said rocker arms, and wherein a rocker shaft is provided on which said rocker arms are mounted for rocking, and said oil supply passage includes a rocker shaft passage defined by the rocker shaft which is connected to the oil pressure chamber means and oil in said rocker shaft passage serves for lubrication, and a hydraulic lash adjuster provided in the first rocker arm and the rocker passage being connected to the hydraulic lash adjuster.

* * * * *